US007458129B2

(12) United States Patent
Escarpa Gil

(10) Patent No.: US 7,458,129 B2
(45) Date of Patent: Dec. 2, 2008

(54) MOP BUCKET

(75) Inventor: Julian Escarpa Gil, Aldaia (ES)

(73) Assignee: SP Berner Plastic Group, S.L., Aldaia (Valencia) (ES)

( * ) Notice: Subject to any disclaimer, the term of this patent is extended or adjusted under 35 U.S.C. 154(b) by 0 days.

(21) Appl. No.: 11/812,731

(22) Filed: Jun. 21, 2007

(65) Prior Publication Data

US 2007/0294853 A1 Dec. 27, 2007

(30) Foreign Application Priority Data

Jun. 23, 2006 (ES) ..... 200601491 U

(51) Int. Cl.
*A47L 13/58* (2006.01)

(52) U.S. Cl. ..... 15/260; 15/264

(58) Field of Classification Search ..... 15/260, 15/264

See application file for complete search history.

(56) References Cited

U.S. PATENT DOCUMENTS 1,992,879 A * 2/1935 Neats ..... 15/264
4,815,160 A * 3/1989 Smith, Jr. ..... 15/264
5,813,567 A * 9/1998 Mangano ..... 220/735

FOREIGN PATENT DOCUMENTS

| | | |
|---|---|---|
| ES | 1 016 710 | 12/1991 |
| ES | 1 025 723 | 1/1994 |
| ES | 1 050 128 | 3/2002 |
| ES | 1 053 905 | 6/2003 |

* cited by examiner

*Primary Examiner*—Randall Chin
(74) *Attorney, Agent, or Firm*—Wenderoth, Lind & Ponack, L.L.P.

(57) ABSTRACT

A bucket is equipped with a rinsing basket in its open end and wheels in its bottom part. The bucket incorporates a pair of wheels going in the same direction placed before a cross-sectional plane that contains the center of gravity. The bottom part contains an ample posterior portion behind the pair of wheels and a narrow frontal portion that extends upwards and outwards and located before the wheels, configured in such a manner that when the bucket is in the at-rest or stationary position it is only supported by the posterior portion, while during the rinsing of the mop, when we press down the frontal part of the bucket with the mop, the bucket will oscillate slightly and will be able to travel if it is set to rest on the wheels by elevating the rear part that will leave the floor during this travelling stage.

3 Claims, 4 Drawing Sheets

MOP BUCKET

FIELD OF THE INVENTION

The present invention relates to a mop bucket intended for cleaning floors with the aid of a mop element associated with the bucket.

The bucket includes a set of wheels that serve to help the bucket travel along. This set of wheels has a particular structure and location.

The bottom portion of the bucket also presents an innovation, as does the location of the center of gravity that is in the vertical plane.

BACKGROUND OF THE INVENTION

Currently, there are mop buckets of different designs; amongst them the buckets with wheels are most noteworthy. These buckets have basically a main body or bucket, the set of wheels affixed to the bottom of the bucket, a handle and a wringer device affixed to the mouth of the main body. These buckets are described in the following documents: U 9302507 (Publication No. ES 1 025 723), U 200202871 (Publication No. ES 1 053 905), and U 200102243 (Publication No. ES 1 050 128).

The wheels, although helping to move the bucket and thus preventing the user from having to drag it or lift it and having to strain unnecessarily, presents the inconvenience that stability may be compromised when pressing the mop down on the wringer to squeeze the water out of it, and to avoid this problem it is necessary that the user holds the bucket simultaneously with his or her feet to avoid the bucket from moving away.

The M.U. 9100002 (Publication No. ES 1 016 710) consists in a mop bucket equipped with two rear wheels facing the same transversal direction and located in the plane before the wringer, and a front wheel, so when the mop is being wringed, the bucket oscillates slightly while resting on the top rear wheels and on a portion of the edge of the bucket's base. The fact that the bucket has to lean on the rear wheels during the operation of the wringing of the mop makes the bucket unstable.

DESCRIPTION OF THE INVENTION

To achieve the objectives and avoid the inconveniences mentioned in the previous sections, the present invention proposes a mop bucket that includes, as basic components, a wringer device and a handle affixed to the appropriate parts of the open upper end or mouth of the bucket.

This mop bucket is also of the type that incorporates wheels to make the task of moving the bucket easier, and preventing the user from having to strain.

The bucket incorporates a wheel device that is strategically placed having two fixed lateral wheels arranged so they face the same transversal position and at least a front foot located in the rear part of the bucket where the wringer is located. The bottom of the bucket is very close to the floor.

Both side wheels are placed before the vertical transversal plane that contains the center of gravity.

The bucket is also characterized in that a portion of the bottom of the front part of the bucket includes a tilted plane having a slight upward and outward inclination.

The bucket normally leans on the floor by seating on the ample rear part of the bottom of the bucket as well as on a pair of lateral sliding elements, this area also includes an intermediate area facing the wringer and another intermediate area that contains the lateral sliding elements and reaches the portion where the side wheels are located. In this situation the wheels do not rest on the floor and we thus achieve a complete stability and safety when pressing down with the mop on the wringer to squeeze the water out of the mop.

This stability during the wringing operation is not achieved even by the Utility Model N° 910002, since both rear wheels in that device continue to sit in contact with the floor during the wringing of the mop.

Therefore, when the mop is wrung to squeeze out the water, the rear part of the bucket is in continuous contact with the floor's surface, avoiding undesired sliding actions and acting as a conventional bucket without wheels.

However, when we want to move the bucket we tilt the bucket forward by exerting pressure with the mop on the front part of the bucket that corresponds to the tilted plane of the bottom portion, causing the rear part to lift from the floor by basculating on the lateral sliding elements and the bucket can then move along by pushing it with the mop. In this travelling stage, the bucket is supported by the frontal wheels and by the tilted plane at the bottom portion. When the user stops pressing on the frontal part of the bucket, the bucket then recovers its stable normal resting position.

The following drawings are included to facilitate graphically the concepts presented in this descriptive report. These figures are an integrated part of the report and are intended to illustrate, and not limit in any way, the object of the present invention.

DESCRIPTION OF THE PREFERRED EMBODIMENT

Figure 1:
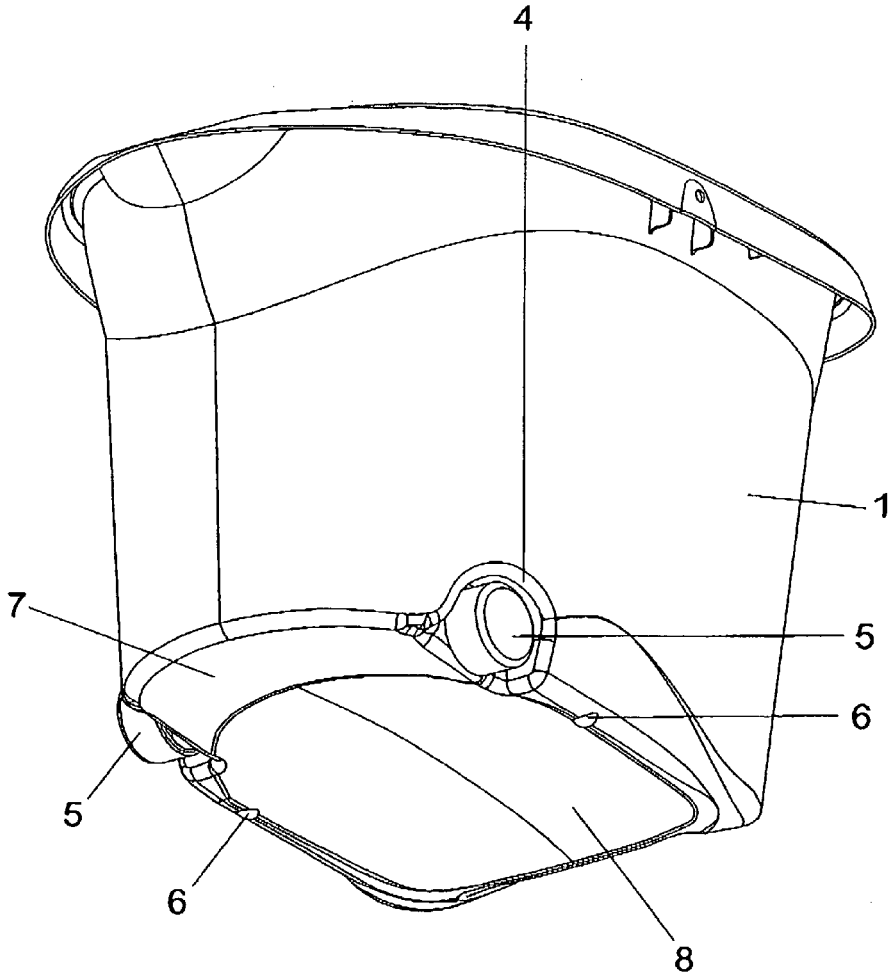
FIG. 1.—Shows a perspective view of the mop bucket of the invention.
Figure 2:
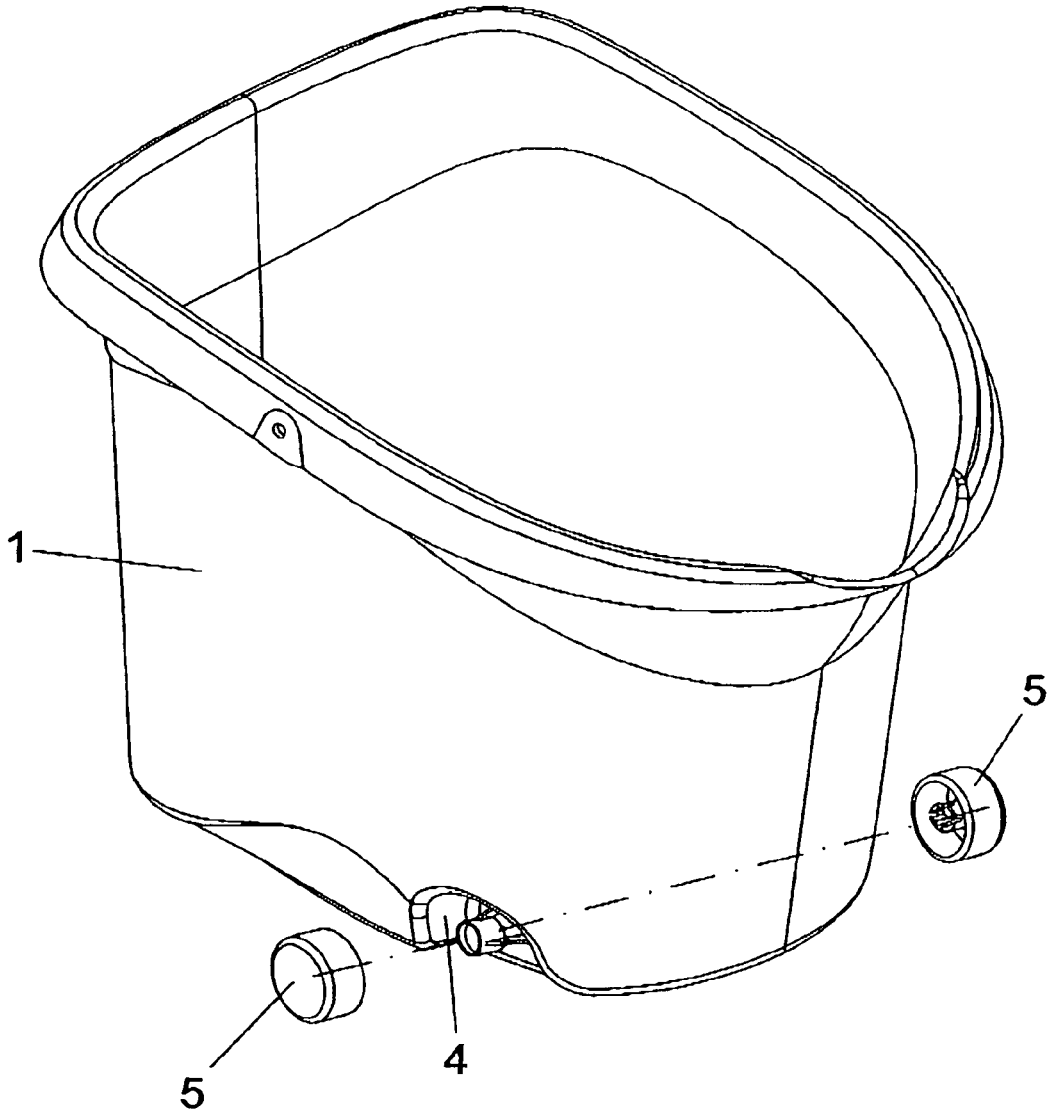
FIG. 2.—Shows a different perspective view of the mop bucket of the invention.
Figure 3:
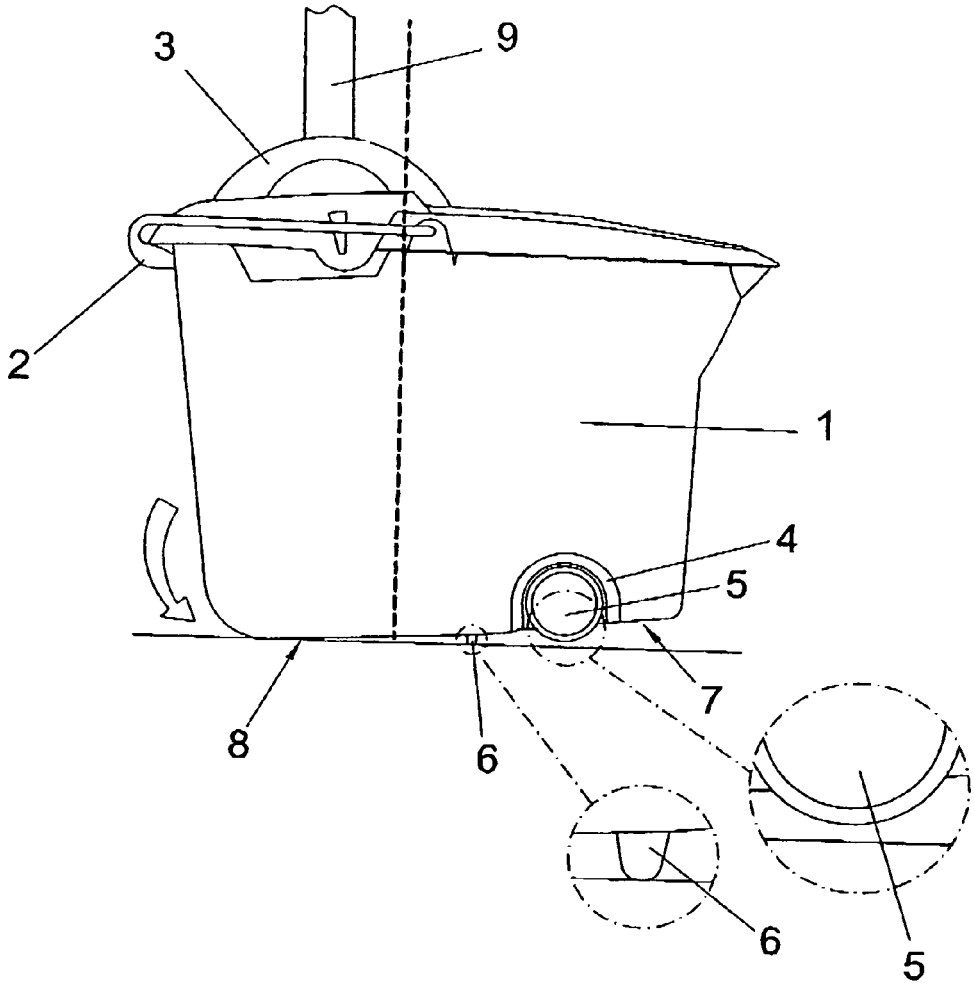
FIG. 3.—Shows a frontal view of the mop bucket of the invention.
Figure 4:
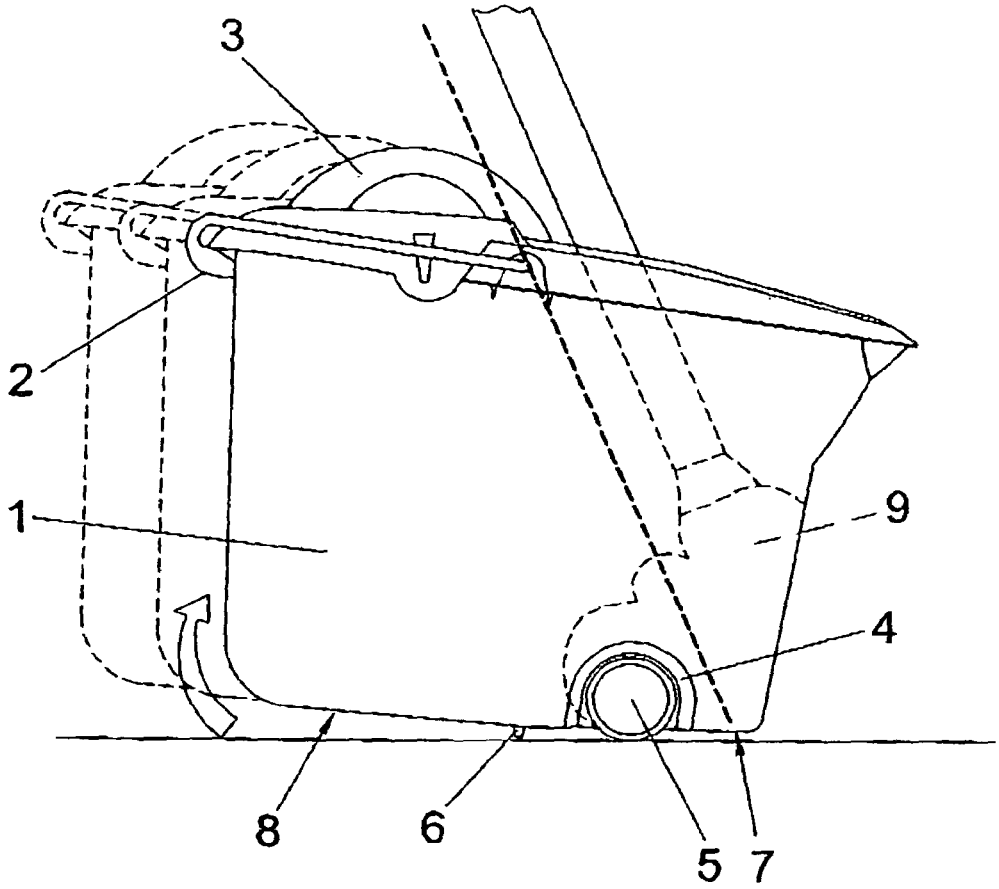
FIG. 4.—Shows a lateral view of the mop bucket of the invention.

The mop bucket of the invention comprises—as indicated by the numbers of the different elements illustrated by the drawings—a hollow body or bucket proper 1 having an open upper part to which is connected, at the least, a centered handle 2, and a wringer device 3 located in the rear part.

On the lowest part of the side panels of the bucket 1 there are two small recesses 4 that hold side wheels 5, facing the same direction and a pair of lateral sliding elements 6 located in a portion 8 towards the rear part of the bottom of the bucket, which also has a narrow tilted anterior portion 7 located before the pair of side wheels 5 and configured with an outward and upward tilt.

The ample posterior part 8 of the bottom of the bucket extending behind the set of wheels 5 and the set of lateral sliding elements 6 together comprise the stable support platform for the bucket 1 when at its normal stationary position, so when the mop 9 is being wrung, these elements provide complete stability for the bucket 1. In this normal stationary position, the set of wheels 5 does not rest in contact with the floor.

On the other hand, when the user needs to move the bucket, and the user will press mop 9 to exert pressure against the anterior part of the bucket 1 causing the posterior part 8 of the bottom of the bucket to lift upwards and basculate on the lateral sliding elements 6 and therefore no longer resting the posterior part 8 against the floor, while the tilted portion 7 will be in contact with the floor. In this situation the set of wheels 5 will also be in contact with the floor and therefore help the bucket 1 travel on the floor easily. In this travelling position the lateral sliding elements 6 are not contacting the floor.

Once the user ceases to press the mop 9 against the frontal part of the bucket 1, the bucket 1 recovers its normal stationary position in which the wheels are not in contact with the floor.

The invention claimed is:

1. A mop bucket comprising a hollow body or bucket having a bottom part and an open upper part, a mop wringer basket provided on said open upper part and a pair of wheels provided on said bottom part, wherein said wheels face the same direction and are located forwardly of a transverse plane that contains the center of gravity, wherein said bottom part comprises a rear portion extending behind said pair of wheels and a narrow front portion that faces outwards and upwards forwardly of said pair of wheels in such a manner that, in a rest position, said bucket is only supported on a floor by said rear portion, and when a mop is pressed against a front part of said bucket, said bucket will oscillate to a traveling position in which said rear portion will be lifted and cease to be supported by the floor, and said bucket will be able to move while being supported by at least said pair of wheels.

2. The mop bucket according to claim 1, wherein said rear portion of said bottom part of said bucket has two lateral sliding elements that lean on the floor while said bucket is placed in said rest position.

3. The mop bucket according to claim 2, wherein said lateral sliding elements constitute a pivot about which said bucket oscillates between said rest position and said travelling position.

* * * * *